US007993211B2

(12) United States Patent
Bardha

(10) Patent No.: US 7,993,211 B2
(45) **Date of Patent: *Aug. 9, 2011**

(54) GOLF CLUB WITH PLURAL ALTERNATIVE IMPACT SURFACES

(76) Inventor: Illir Bardha, West Bloomfield, MI (US)

( * ) Notice: Subject to any disclaimer, the term of this patent is extended or adjusted under 35 U.S.C. 154(b) by 45 days.

This patent is subject to a terminal disclaimer.

(21) Appl. No.: 12/685,511

(22) Filed: Jan. 11, 2010

(65) Prior Publication Data

US 2010/0113177 A1 May 6, 2010

Related U.S. Application Data

(63) Continuation of application No. 12/257,481, filed on Oct. 24, 2008, which is a continuation of application No. 11/469,178, filed on Aug. 31, 2006, now Pat. No. 7,442,129.

(60) Provisional application No. 60/758,350, filed on Jan. 12, 2006.

(51) Int. Cl.
*A63B 69/36* (2006.01)
*A63B 53/04* (2006.01)

(52) U.S. Cl. ..... 473/251; 473/288; 473/329; 473/340; 473/342

(58) Field of Classification Search ..... 473/244–248, 473/288, 251, 313, 314, 324–350
See application file for complete search history.

(56) References Cited

U.S. PATENT DOCUMENTS

| | | | | | |
|---|---|---|---|---|---|
| 645,942 | A | | 3/1900 | Cran | |
| 1,165,559 | A | | 12/1915 | Vories | |
| 1,219,417 | A | | 3/1917 | Vories | |
| 1,343,998 | A | | 6/1920 | Grant | |
| 1,453,503 | A | | 5/1923 | Holmes | |
| 1,556,928 | A | * | 10/1925 | Ganders | 473/245 |
| 1,644,177 | A | * | 10/1927 | Collins | 473/247 |
| 1,974,224 | A | * | 9/1934 | Va Der Linden | 273/317.2 |
| 1,983,196 | A | * | 12/1934 | Spiker | 473/247 |
| 2,460,445 | A | | 2/1949 | Bigler | |
| 2,820,638 | A | * | 1/1958 | Morrison | 473/252 |
| 2,998,254 | A | | 8/1961 | Rains et al. | |
| 3,214,169 | A | * | 10/1965 | Rupnow | 473/246 |
| 3,840,231 | A | * | 10/1974 | Moore | 473/245 |
| 3,845,960 | A | | 11/1974 | Thompson | |
| 3,937,474 | A | * | 2/1976 | Jepson et al. | 473/342 |
| 3,979,122 | A | | 9/1976 | Belmont | |
| 4,008,896 | A | | 2/1977 | Gordos | |
| 4,121,832 | A | * | 10/1978 | Ebbing | 473/335 |
| 4,422,638 | A | * | 12/1983 | Tucker | 473/329 |
| 4,607,846 | A | | 8/1986 | Perkins | |
| 4,679,792 | A | * | 7/1987 | Straza et al. | 473/329 |
| 4,681,322 | A | * | 7/1987 | Straza et al. | 473/329 |
| 4,768,787 | A | * | 9/1988 | Shira | 473/331 |
| 4,878,666 | A | * | 11/1989 | Hosoda | 473/247 |
| 4,895,371 | A | | 1/1990 | Bushner | |
| 4,962,932 | A | | 10/1990 | Anderson | |
| 5,013,041 | A | | 5/1991 | Sun et al. | |

(Continued)

*Primary Examiner* — Sebastiano Passaniti

(74) *Attorney, Agent, or Firm* — Gifford, Krass, Sprinkle, Anderson & Citkowski, P.C.

(57) ABSTRACT

A golf club having a shaft and an elongated head projecting at a lie angle relative to the shaft, the head having the shape of a regular polygon in a cross section at right angles to the central axis of the head, with each face being formed of a material that provides a different ball rebound factor, the head section being rotatable about the central axis so that any one of the faces may be presented for use with the club.

12 Claims, 7 Drawing Sheets

U.S. PATENT DOCUMENTS 5,083,778 A * 1/1992 Douglass ..... 473/329
5,154,425 A * 10/1992 Niskanen et al. ..... 473/342
5,244,210 A * 9/1993 Au ..... 473/252
5,385,346 A * 1/1995 Carroll et al. ..... 473/247
5,458,332 A * 10/1995 Fisher ..... 473/251
5,470,063 A * 11/1995 Fisher ..... 473/248
5,489,097 A 2/1996 Simmons
5,571,053 A 11/1996 Lane
5,580,051 A * 12/1996 Fisher ..... 473/248
5,584,769 A * 12/1996 Sundin ..... 473/325
5,603,666 A 2/1997 Bowe
5,674,132 A * 10/1997 Fisher ..... 473/290
5,688,189 A 11/1997 Bland
5,749,790 A 5/1998 Van Alen, II et al.
5,807,190 A * 9/1998 Krumme et al. ..... 473/342
5,921,871 A * 7/1999 Fisher ..... 473/329
5,928,088 A * 7/1999 Matthews ..... 473/313
6,227,986 B1 * 5/2001 Fisher ..... 473/342
6,238,303 B1 * 5/2001 Fite ..... 473/342
6,270,422 B1 * 8/2001 Fisher ..... 473/223
6,270,423 B1 * 8/2001 Webb ..... 473/226
6,287,215 B1 * 9/2001 Fisher ..... 473/309
6,336,869 B1 * 1/2002 Hettinger et al. ..... 473/324
D459,422 S * 6/2002 Fisher ..... D21/742
6,440,006 B1 8/2002 Johnson
6,533,678 B1 3/2003 Johnson
6,695,708 B2 * 2/2004 Fisher ..... 473/244
6,723,000 B1 * 4/2004 Dombrowski ..... 473/239
7,341,527 B1 * 3/2008 Fisher ..... 473/329
7,442,129 B2 * 10/2008 Bardha ..... 473/251
2002/0198060 A1 * 12/2002 Fisher ..... 473/244
2003/0052175 A1 3/2003 Tsikos et al.
2003/0071124 A1 4/2003 Tsikos et al.
2003/0080190 A1 5/2003 Tsikos et al.
2003/0080192 A1 5/2003 Tsikos et al.
2004/0209703 A1 * 10/2004 Middleton ..... 473/340
2006/0086794 A1 4/2006 Knowles et al.

* cited by examiner

GOLF CLUB WITH PLURAL ALTERNATIVE IMPACT SURFACES

CROSS-REFERENCE TO RELATED APPLICATIONS

This application is a continuation of U.S. patent application Ser. No. 12/257,481 filed Oct. 24, 2008, which is a continuation of U.S. patent application Ser. No. 11/469,178 filed Aug. 31, 2006, now U.S. Pat. No. 7,442,129, which claims priority of U.S. Patent Application 60/758,350 filed Jan. 12, 2006.

FIELD OF THE INVENTION

This invention relates to an adjustable golf club, and more particularly to an adjustable putter with an elongated head with a central axis extending at a lie angle relative to the shaft and formed with a plurality of faces each having a different rebound factor. The head is rotatable about its central axis to present one of these faces for ball-impacting use.

BACKGROUND OF THE INVENTION

It has long been recognized that the hardness and coefficient of restitution of the impact face of a golf club will affect the force imparted to the ball when a club is swung with a given speed. Materials which will provide an appropriate range of forces often differ from the material with which the golf head is constructed, so it has been proposed to provide golf clubs with inserts of particular materials chosen for their hardness and rebound coefficients (which will hereinafter be collectively referred to as "impact factors"). U.S. Pat. No. 3,937,474 discloses a golf club with a polyurethane insert on the striking face that provides an advantageous impact factor to balls hit with the club.

It has also been proposed to make these inserts detachable so that the impact face of a club may be altered to provide an insert which is chosen based on the condition of the course. For example, when the greens have short grass and are relatively hard, i.e. "fast", an insert with a relatively low impact factor is chosen, but when the grass is longer, or damp, so that the green is "slow", an insert with a high impact factor is chosen. This allows a golfer to use substantially the same stroke with fast and slow greens and to impart forces on the golf ball which are consistent with these conditions. See, for example, U.S. Pat. No. 5,921,871.

Rather than requiring an insert to be changed in order to alter the force induced on a ball using a relatively consistent stroke, it has been proposed to provide a multiple-faced head for a golf putter in which the different faces have different ball-impacting characteristics. U.S. Pat. No. 6,695,708 discloses such an adjustable putter. The head is polygonal in shape and is affixed to the club shaft so that all of the faces lie in the vertical plane when the club is in use. The head has a polygonal socket on its upper surface which mates with a male polygonal member disposed at one end of the hosel so that the hosel may be inserted into the head into a position which supports one of the faces in a ball-impacting position. The head is unusual in shape, in no way resembling a conventional golf putter, and the weighting created by this unusual shape is unconventional and may well be confusing to the golfer.

SUMMARY OF THE INVENTION

The present invention is accordingly directed toward a golf club and more particularly a putter, which has a head with a plurality of faces, each having a different impact factor when hitting a golf ball, which may be positionally adjusted to place one of the faces into a golf ball hitting position. More particularly, it is directed toward such a club in which the head is of a conventional shape with a central axis that is disposed at a chosen lie angle relative to the club shaft so it may be positionally adjusted in a rotational manner about the central axis to place one of the faces in ball-impacting position.

A preferred embodiment of the invention which will subsequently be disclosed in detail employs a head having a section which is formed as a regular polygon, symmetrical about the central axis of the head. The polygonal section may be rotated about its central axis so as to dispose one of the planar faces, having a chosen impact factor, in ball-impacting position.

The preferred embodiment of the invention employs a heel fixed to the club neck and a regularly polygonal blade section which extends from the heel at the chosen lie angle. The heel and the blade are formed with complementary sections that may be positioned in abutment to one another to fix the blade in a chosen rotational position relative to the heel or may be separated from one another to allow rotation of the blade with respect to the heel to select a particular ball-impacting face.

In one preferred embodiment a bolt extends through a longitudinal hole in the blade and its threaded end fastens in a threaded hole in the section of the heel that abuts the end of the blade. The threaded fastener may be rotated to lock the two into a chosen position or may be loosened to separate the two and allow rotation to another desired position, placing another face in ball-impacting position.

In one embodiment which will be subsequently disclosed, a generally tubular weighting element of a selected weight may be supported in the hole of the head around the threaded fastener to adjust the weight of the head.

Alternatively, the club may incorporate a toe portion which is symmetrical in shape and rotates with the rotationally adjustable blade section, or is nonsymmetrical and remains in a constant position relative to the heel independent of the rotational position of the blade. The putter may also incorporate a mallet-like section which extends from the heel, toe and blade, away from the ball-impacting face.

BRIEF DESCRIPTION OF THE DRAWINGS

Other objects, advantages and applications of the present invention will be made apparent by the following detailed description of preferred embodiments of the invention. The description makes reference to the accompanying drawings in which.

DETAILED DESCRIPTION OF PREFERRED EMBODIMENTS

Figure 1:
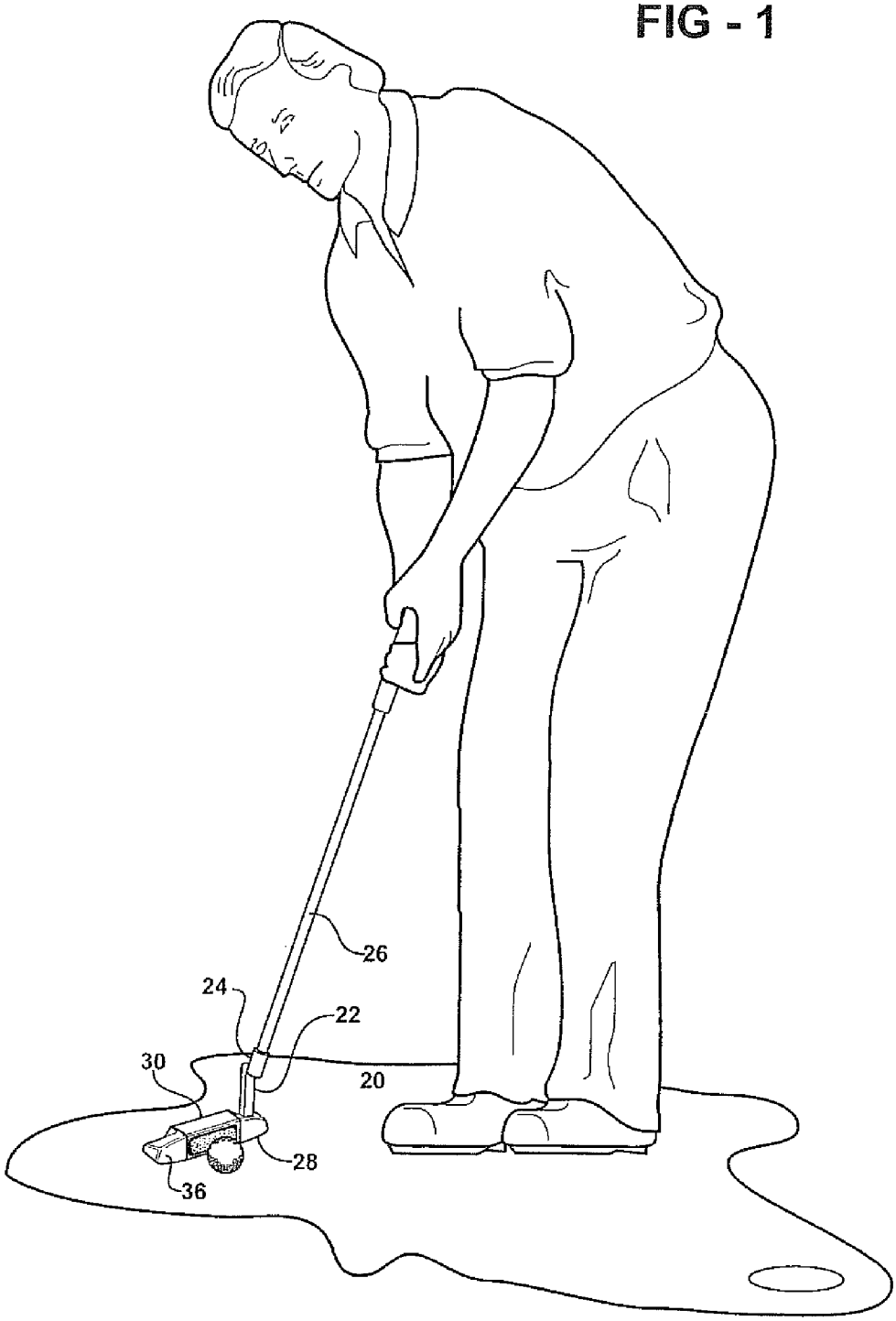
FIG. 1 is a perspective view of a golfer using a first preferred embodiment of a club formed in accordance with the present invention.
Figure 4:
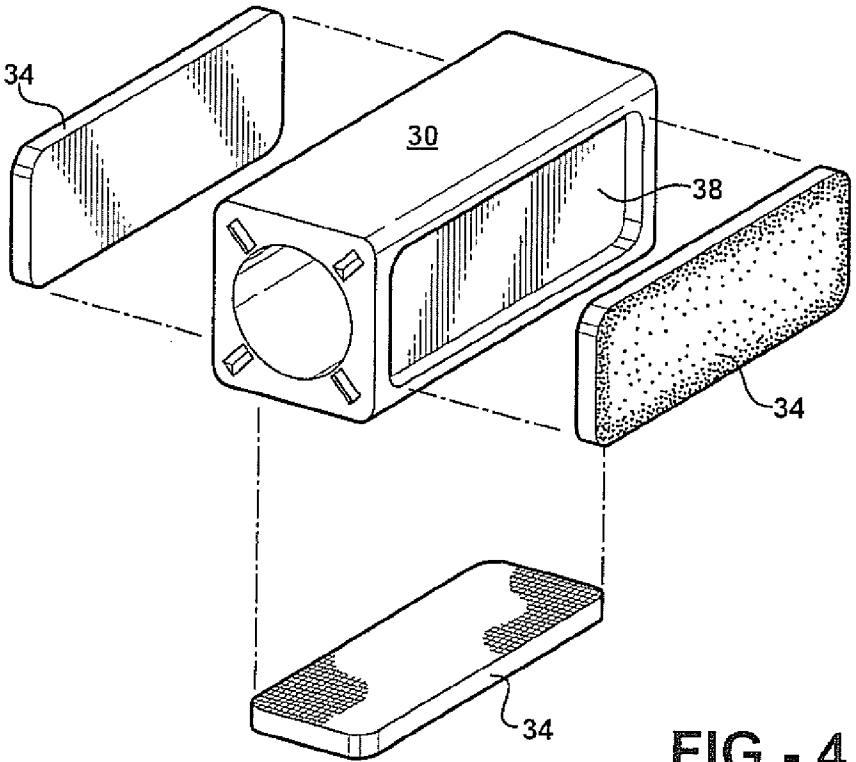
FIG. 4 is a perspective view of the rotatable blade section of the club with the face inserts separated from the blade section.
Figure 2:
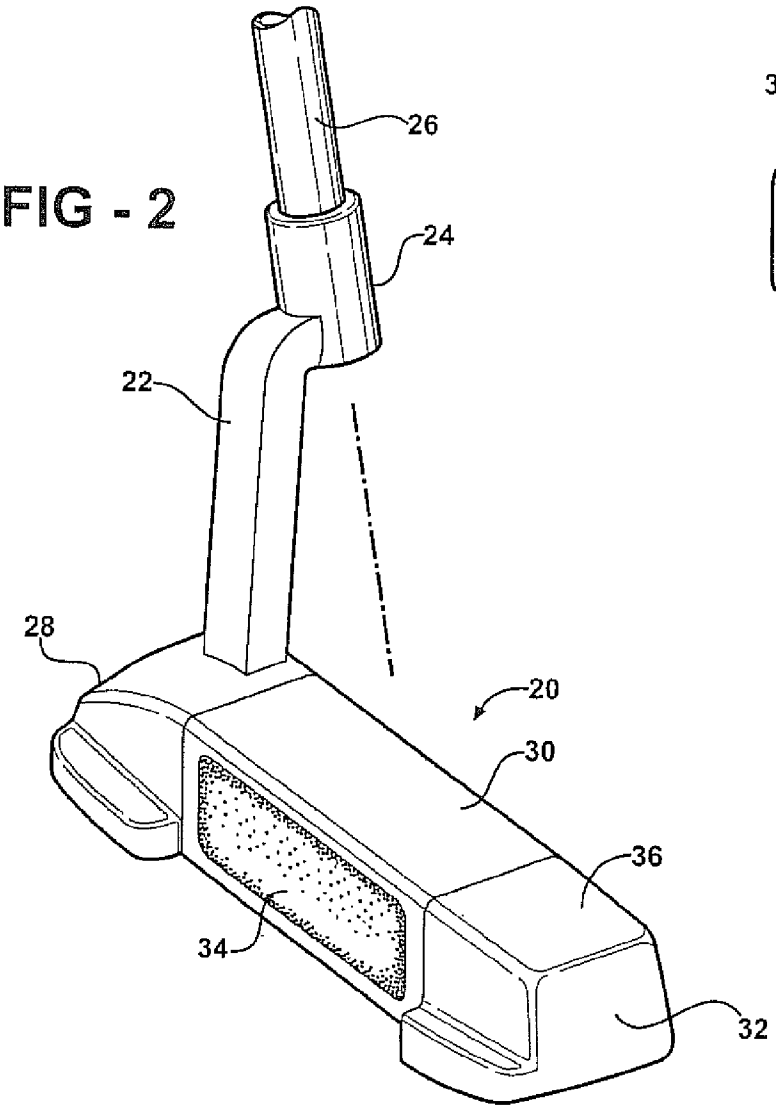
FIG. 2 is a detailed perspective view of the head of the club of FIG. 1.

Referring to the drawings, FIGS. 1-6 illustrate a first embodiment of a golf putter formed in accordance with my invention, generally indicated at 20. The head 20 includes a neck or hosel 22 which terminates at its upper end in a tubular section 24 adapted to receive a golf club shaft 26. The lower end of the hosel 22 is fixed within the upper surface of a heel 28 forming part of the golf club head. One side surface of the heel abuts an end surface of a rotatable blade section 30 which is square in cross section. The blade 30 is elongated and is formed about what will be termed a central axis 32. The opposite side of the blade is formed in abutment to a vertical surface of a toe section 36. Heel section 28 and toe section 36 have the configuration and are weighted like popular conventional golf putters.

The angle between the axis of the shaft 26 and the central axis 32 of the head is termed the lie of the club. On a putter it may vary between approximately 90 degrees and 50 degrees. The central axis of the blade 30 extends at the lie angle relative to the shaft 26.

Figure 3:
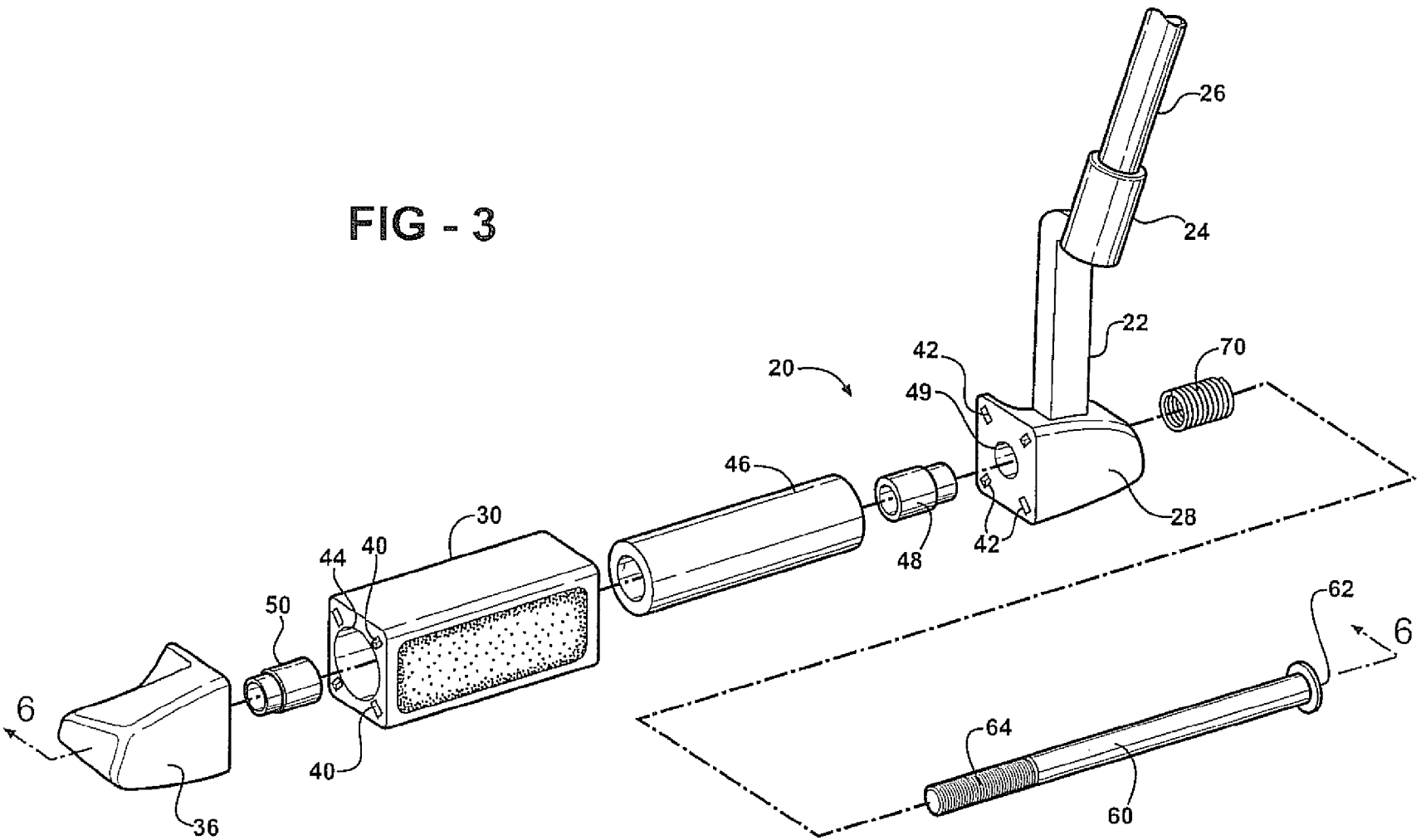
FIG. 3 is an exploded, perspective view of the components that form the golf club head of FIG. 1.
Figure 5:
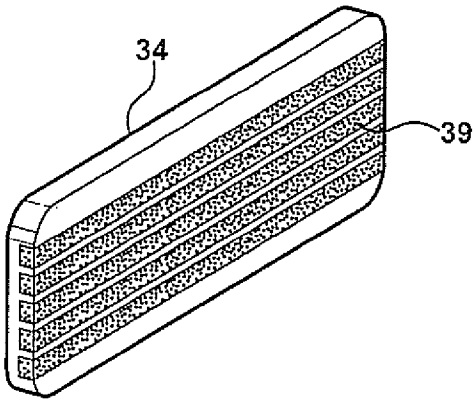
FIG. 5 is a perspective view of an insert for one of the faces of the blade section employing a series of serrations to improve the grip of the face on an impacted ball.

The blade section 30 is illustrated as rectangular in cross section about a plane normal to its central axis. The blade section 30 is preferably a regular polygon, but it could employ a number of faces other than four, such as three, five, six, etc. The faces are arrayed at equal angles about the central axis. Each of the faces of the blade 30 is designed to provide a different impact factor upon contact with a golf ball. The faces may differ in hardness, rebound factor or the like. Different hardness and rebound factors can be formed by making the faces of different materials and the blade 30 is illustrated as having one face formed of the same as the base material and other faces formed with conventional inserts 34 which fit within recesses 38 formed in the center of the face. Thus, as illustrated in FIG. 3, a rectangular blade may have three inserts 34 formed in recesses 38 on three of its sides, and the fourth side may be formed of the same base material as the blade. For example, the blade may be formed of chrome steel and the inserts may be formed of various densities of polymers such as polyurethanes, Kevlar or the like, or metals such as titanium, aluminum, sintered carbides, etc., or composites of fibers and polymers. As illustrated in FIG. 5, a blade face insert may have striations 39 or other formations formed on its surface to vary the ball gripping properties of the insert. Alternative grooves could be filled with different materials than the base insert. For example, the base could be formed of aluminum with urethane disposed in the grooves.

Figure 6:
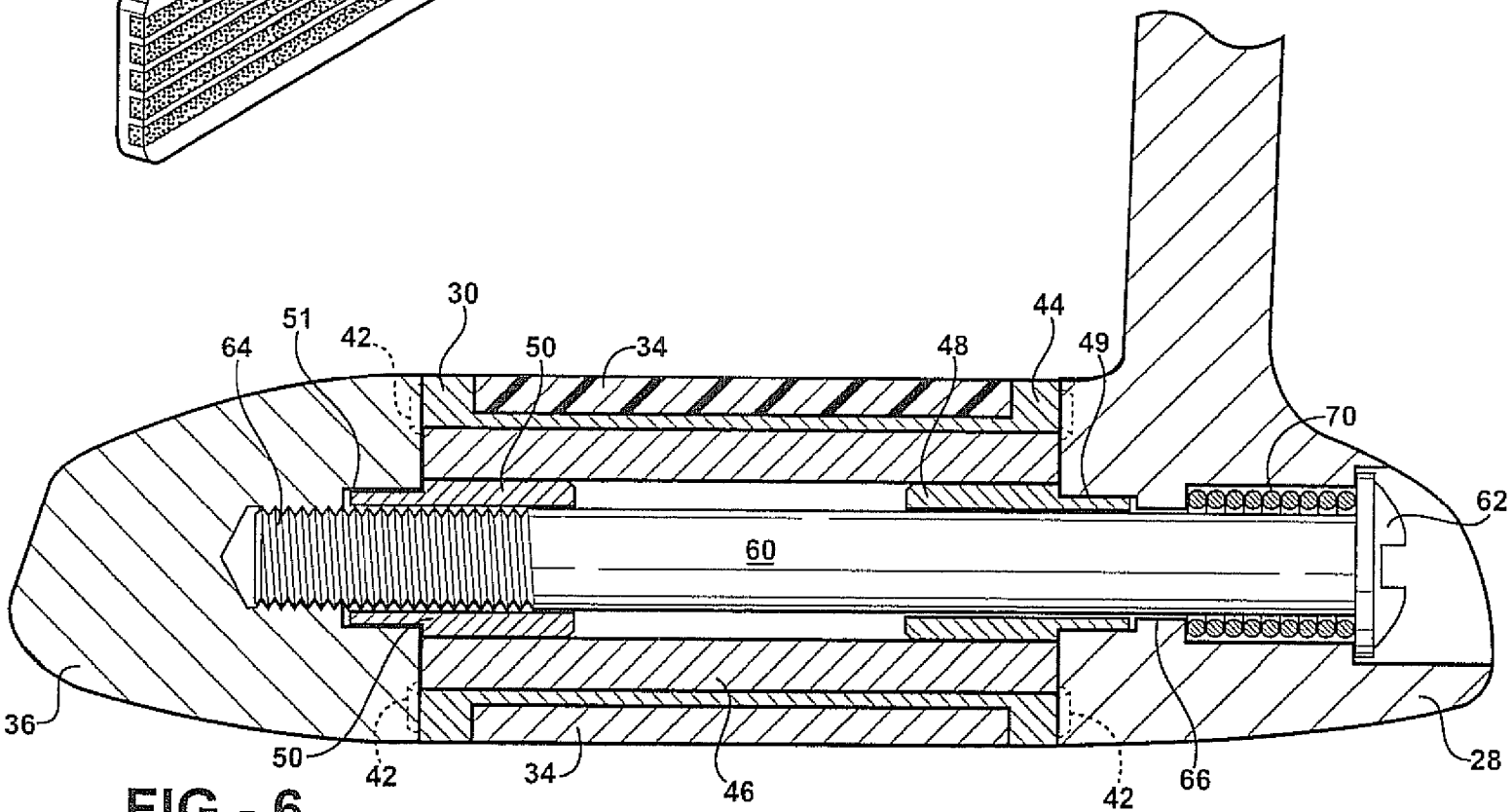
FIG. 6 is a cross-sectional view of the golf club head of FIGS. 1 and 2 taken along line 5-5 of FIG. 2.

As illustrated in FIGS. 3 and 6, the end surfaces of the blade 30 may be formed with equally spaced sections 40 which may be depressions, extending tabs, or various combinations thereof. These sections are arrayed symmetrically about the central axis of the blade 30 and are adapted to mate with similar depressions or tabs 42 formed on the complementary vertical surfaces of the heel 28 and the toe 36.

The blade 30 has a central circular hole 44 extending entirely through the body about the central axis. A cylindrical tubular weight 46, having an outer diameter complementary to the inner diameter of the hole 44, is adapted to be inserted into the hole and to receive, within its inner diameter, extending tubular sections 48 and 50 which project from the central axis of the mating surfaces of the heel 28 and toe 36 respectively. A smaller diameter end of the section 48 projects into a central hole 49 in the heel 28 and a similar formation on the section 50 projects into a hole 51 in the toe 36. Thus the tubular weight 46 is disposed within a blade section 30 and the sections 48 and 50 extend into the exposed ends of the tube 46 and when they are brought into abutment, the sections 42 on the toe and heel lock with the sections 40 on the two ends of the blade 30 to prevent rotation of the blade.

A bolt 60 having a head 62 at one end and a thread 64 at the other end is adapted to pass through a central hole 66 formed through the heel 28, through the central hole in the weight 46 nestled within the blade 30 and to thread into a complementary female thread in a central aperture in the toe 36. By rotating the fastener 62 through an appropriate groove formed in its head, the toe and heel sections may be brought into abutment with the blade 30 and lock the blade in a chosen rotational position. By rotating the bolt 60 in the opposite direction, the abutting sections 40 and 42 may be separated allowing the blade 30 to be rotated about its central axis, relative to the heel 28 to present a different face in ball-impacting position.

A compression spring 70 is supported over the fastener 60 so as to be compressed between the inner side of the head 62 and an abutting shoulder section of the heel 28 when the fastener 62 is in a locked position. This maintains the tension on the bolt and prevents accidental loosening or vibration during swing of the club, and maintaining the parts of the head biased toward another during rotation of the blade 30.

A conventional screwdriver or Allen wrench may be used to tighten and loosen the fastener 62.

A club formed in accordance with FIG. 1 meets the standards of the United States Golf Association in requiring a tool to change the rotational position of the blade 30 and prevents it from being changed during a round of golf. In other embodiments of the invention which do not necessarily conform to USGA standards, the club could be assembled so as to allow adjustment of the faces without use of a tool.

Figure 7:
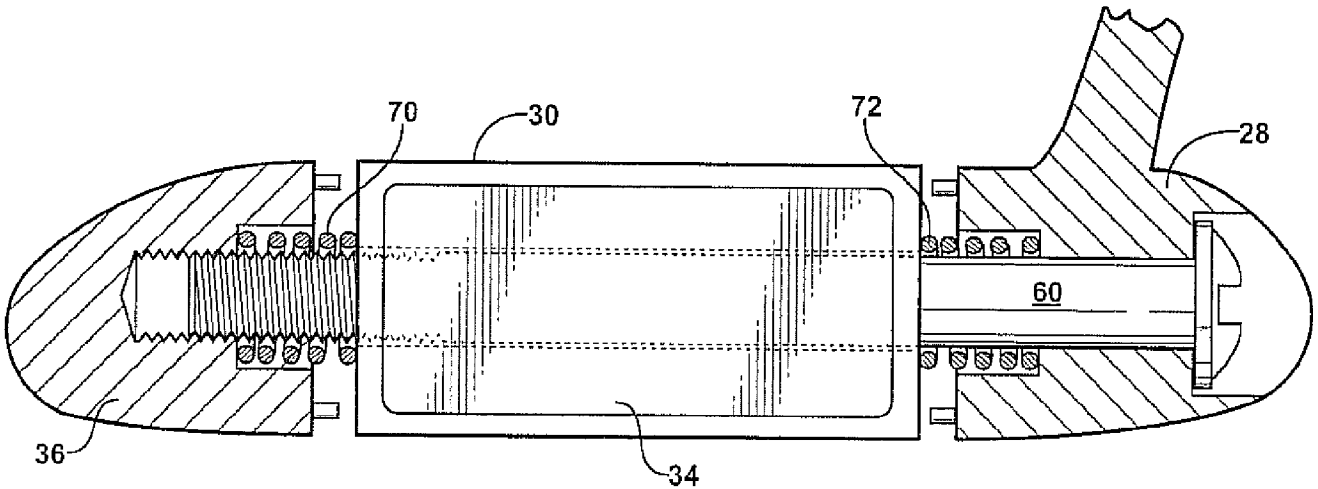
FIG. 7 is a cross-sectional view of a second embodiment of a club head formed in accordance with my invention employing springs between the blade section and both the heel and toe sections.

Another embodiment of the invention is illustrated in FIG. 7. The alternative embodiment of the invention illustrated in FIG. 7 is much like the club illustrated in FIGS. 1-6 and like numbers are used on similar parts. It differs from the embodiment of FIGS. 1-6 in that a pair of springs are employed, one 70 surrounding the threaded fastener 60 between the abutting surfaces of the toe 36 and the blade 30, and a second 72 surrounding the threaded fastener 60 between the abutting surfaces of the heel 28 and the blade 30. When the threaded fastener is released, these springs push the blade 30 apart from the heel 28 and the toe 36 to allow easy rotation of the blade 30 to change the impact face. Otherwise, the embodiment is the same.

Figure 8:
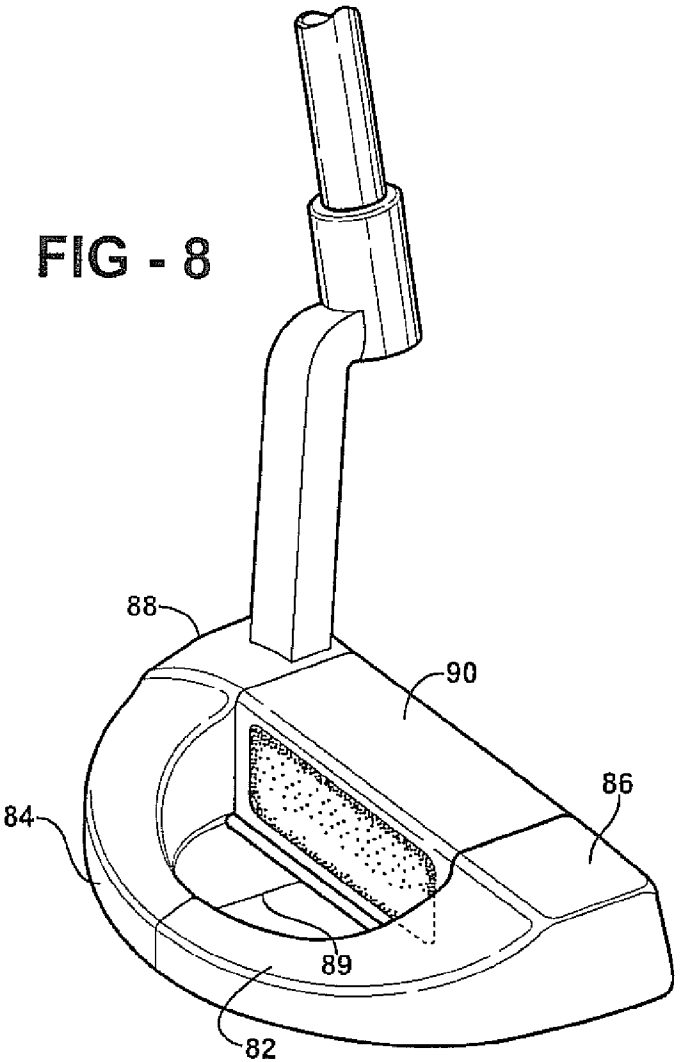
FIG. 8 is a perspective view of still another embodiment of the club of my invention taking the form of a mallet structure.

FIG. 8 illustrates another embodiment of a club of the present invention which differs from the other embodiments in including two mallet sections 82 and 84 affixed to, or formed integrally with, the toe 86 and heel 88 respectively. The two sections 82 and 84 abut one another along a line 89 where the heel and toe are brought into abutment to lock the blade 90 in a chosen rotational position. The extending sections 82 and 84 give a weight distribution and appearance to the putter that many golfers prefer.

Figure 9:
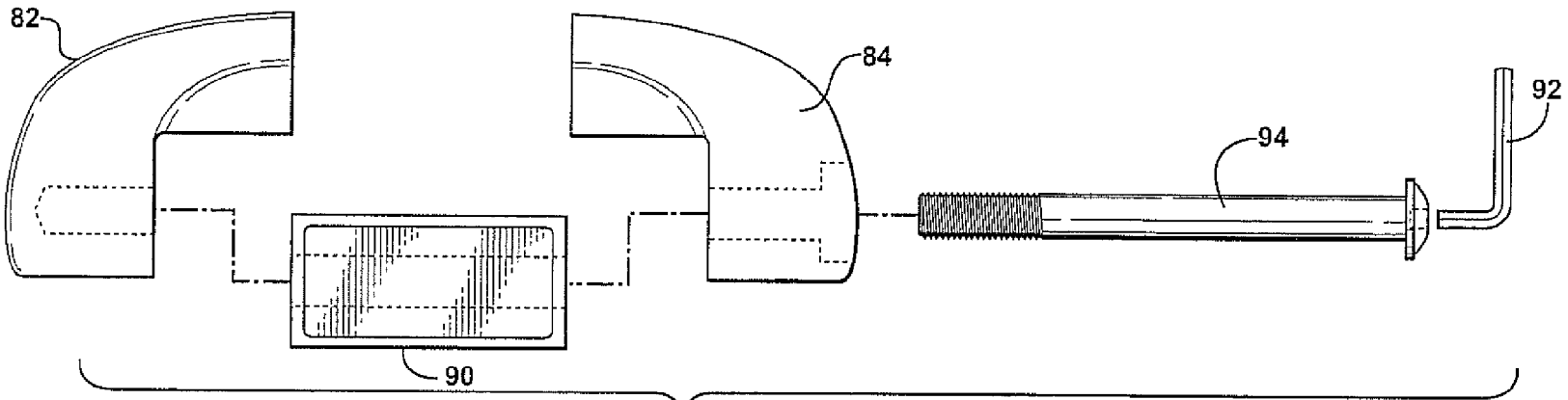
FIG. 9 is an exploded view of the components of a mallet section and a tool for loosening a bolt to allow rotation of the blade section to alter the impact face used.

FIG. 9 illustrates the sections in exploded form and illustrates the manner in which an Allen wrench 92 may be used with the threaded fastener 94 with an appropriate head, to join the sections. The abutting contact line 89 of the two mallet sections also provide an aiming line for a golfer using the putter.

Figure 10:
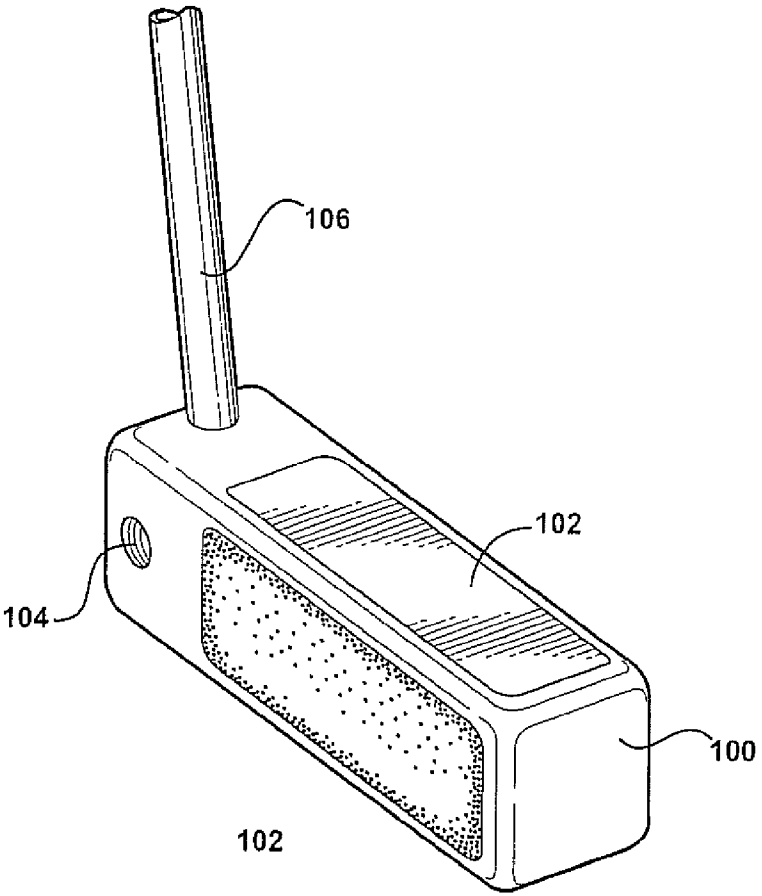
FIG. 10 is a perspective view of still another embodiment of my invention wherein the rotational position of the blade is altered to present alternative club faces by changing the position of engagement between the shaft or shank and the blade section.

FIG. 10 discloses another alternative embodiment of the invention which employs a polygonal blade section 100 with inserts 102 on at least three of the faces so that a different impact factor is provided on each face. The blade 100 includes apertures 104 on each face, any one of which can receive the end of an extending shaft 106. This allows the shaft to join directly to the blade, without any special heel section. By removing the shaft 106 from one of the apertures 102 and placing it in one of the other such as 104, the blade 100 can be rotated relative to the shaft 106 to provide a different impact surface.

Figure 11:
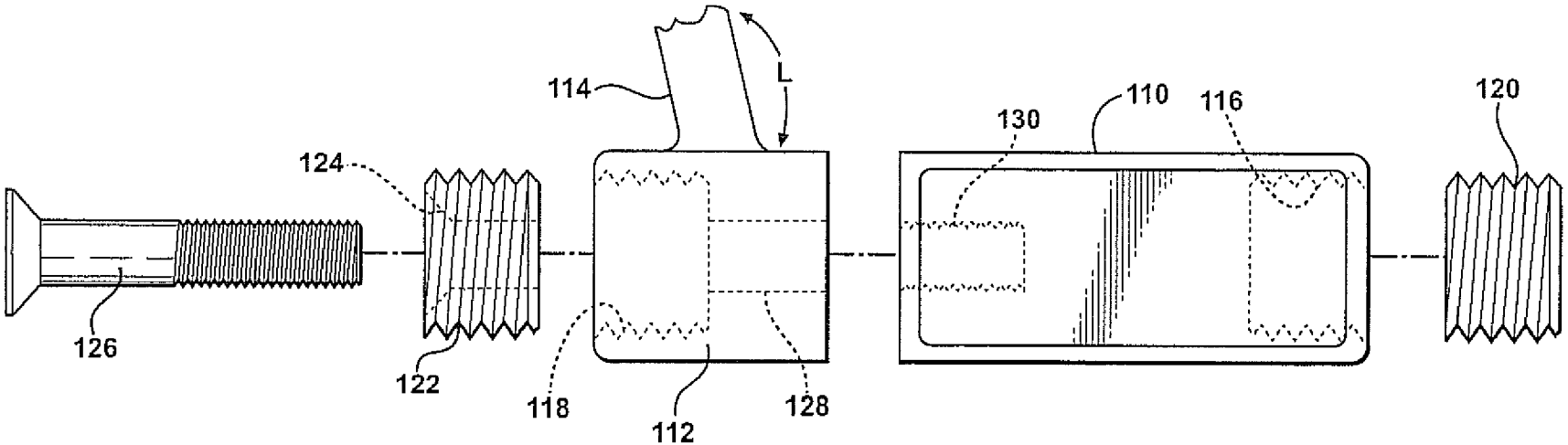
FIG. 11 is an exploded view of still another embodiment of my invention incorporating a novel weighting system.

FIG. 11 illustrates another embodiment of the invention in which a regular polygonal head section 110 with plural faces providing different impact factors is joined to a heel section 112 extending at a lie angle denoted as "L" to a shaft 114. A pair of threaded cylindrical recesses 116 and 118 are formed in the forward end of the head 110 and in the rear of the heel 112, both on the center line of the head. Cylindrical weights 120 and 122, threaded on their outer diameters, may be inserted into the recesses 116 and 118 respectively to accomplish weighting of the putter. The weights 120 and 122 may be made available in a variety of lengths or densities to allow adjustment of the weighting.

The weight 122 has a central hole 124, which allows a bolt 126 to pass through a central hole 128 in the heel 112, communicating with the recess 118, and thread into a recess 130 in the head 110. The bolt may be loosened to allow rotation of the head 112 about its central axis to present a putting face with a chosen impact factor and then tightened to secure the head relative to the heel.

The invention claimed is:

1. In a golf club having an elongated shaft and a head having a central axis, the head being connected to the shaft so that the central axis of the head intersects and extends at an angle to said shaft so that the shaft and the central axis of the head lie in a common plane, the improvement comprising:

the head comprising a heel section fixed to one end of the shaft and an adjustable section, rotatable supported relative to the heel section, having a plurality of planar faces extending in planes parallel to the central axis, the adjustable section being rotatable about its central axis to any one of a plurality of orientations, so that in each rotational position one of the planar faces is disposed in a ball-impacting position relative to the shaft, at least certain of the planar faces having different rebound factors when impacting a ball.

2. The golf club of claim 1 in which the angle between the central axis of the head and the shaft is a near right angle.

3. The golf club of claim 1 wherein at least certain of the planar faces of the adjustable section of the head comprise a recess adapted to receive an insert formed of a different material than the head.

4. The golf club of claim 1, further comprising a two part separable fastener having one part formed on the heel and the other part formed on the adjustable section of the head, the fastener adopted to allow the adjustable section to be connected to the heel at one of a plurality of rotational positions of the adjustable section relative to the central axis.

5. The golf club of claim 1 wherein the separable fastener comprises complementary sections that may be positioned in abutment to one another to fix the adjustable section in a chosen rotational position or may be separated from one another to allow rotation of the adjustable section relative to the heel.

6. The golf club of claim 5 wherein the adjustable section comprises a hole formed through its central axis and the separable fastener element extends through the hole.

7. The golf club of claim 6 wherein the rotational fastener element comprises a bolt having a slotted head in one end and a male angle engagement section formed at the other end.

8. The golf club of claim 7 further comprising a compression spring supported on the bolt, adjacent the bolt head, so that when the bolt is rotated so as to bring the blade and the heel into abutment, the spring is compressed.

9. The golf club of claim 8 wherein the heel has a hole formed with a female angle engagement section adapted to receive the male angled engagement section formed at one end of the bolt.

10. The golf club of claim 9 further comprising an elongated weighting element having a central hole adapted to be inserted into the hole formed through the central axis of the blade so the rotational fastener element may be passed through the central hole of the weighting element, whereby weighting elements of different weights may be selectably disposed within the adjustable section.

11. The golf putter of claim 1 wherein the adjustable section further comprises a toe portion symmetrical about said central axis.

12. In a golf club having an elongated shaft and a head having a central axis, the head being connected to the shaft so that the central axis of the head intersects and extends at an angle to said shaft, the improvement comprising:

the head comprising a heel section fixed relative to the shaft and an adjustable section, rotatably supported relative to the shaft and heel section, which is square in cross section in a plane normal to the central axis, with four planar faces, the adjustable section being rotatable about its central axis to any one of four orientations, so that in each rotational position one of the planar faces of the square is disposed in a ball-impacting position relative to the shaft, at least certain of the planar faces having different rebound factors when impacting a ball.

* * * * *

UNITED STATES PATENT AND TRADEMARK OFFICE

CERTIFICATE OF CORRECTION

PATENT NO. : 7,993,211 B2
APPLICATION NO. : 12/685511
DATED : August 9, 2011
INVENTOR(S) : Ilir Bardha It is certified that error appears in the above-identified patent and that said Letters Patent is hereby corrected as shown below:

Title Page, Item (76) Inventor:  Illir Bardha  should read --Ilir Bardha--

Signed and Sealed this
Twenty-first Day of February, 2012

David J. Kappos

David J. Kappos
*Director of the United States Patent and Trademark Office*